US010226131B2

(12) United States Patent
Thurow

(10) Patent No.: US 10,226,131 B2
(45) Date of Patent: Mar. 12, 2019

(54) ARTICULATED BACK SOFA BED

(71) Applicant: FLEXSTEEL INDUSTRIES, INC., Dubuque, IA (US)

(72) Inventor: Jerry A. Thurow, Dubuque, IA (US)

(73) Assignee: FLEXSTEEL INDUSTRIES, INC., Dubuque, IA (US)

( * ) Notice: Subject to any disclaimer, the term of this patent is extended or adjusted under 35 U.S.C. 154(b) by 371 days.

(21) Appl. No.: 14/954,562

(22) Filed: Nov. 30, 2015

(65) Prior Publication Data

US 2016/0150888 A1 Jun. 2, 2016

Related U.S. Application Data

(60) Provisional application No. 62/085,987, filed on Dec. 1, 2014.

(51) Int. Cl.

| | |
|---|---|
| ***A47C 17/04*** | (2006.01) |
| ***A47C 17/26*** | (2006.01) |
| ***A47C 27/04*** | (2006.01) |
| ***A47C 17/14*** | (2006.01) |
| ***A47C 1/02*** | (2006.01) |
| ***A47C 17/207*** | (2006.01) |
| ***A47C 17/175*** | (2006.01) |

(52) U.S. Cl.
CPC ..... *A47C 17/2076* (2013.01); *A47C 17/1756* (2013.01)

(58) Field of Classification Search
CPC ..... A47C 17/13; A47C 17/132; A47C 17/134; A47C 17/136; A47C 17/138; A47C 17/16; A47C 17/161; A47C 17/162; A47C 17/163; A47C 17/165; A47C 17/1655; A47C 17/17; A47C 17/175; A47C 17/1753; A47C 17/1756; A47C 17/18; A47C 17/207; A47C 17/2073; A47C 17/2076; A47C 17/213
See application file for complete search history.

(56) References Cited

U.S. PATENT DOCUMENTS

| | | | | |
|---|---|---|---|---|
| 2,250,148 A * | 7/1941 | Bonnet | ..... | A47C 17/134 5/18.1 |
| 2,644,171 A | 7/1953 | Lorenz | | |
| 3,165,757 A * | 1/1965 | Rogers, Jr. | ..... | A47C 17/23 5/13 |
| 3,253,283 A * | 5/1966 | Wiberg | ..... | A47C 17/132 5/21 |
| 3,456,268 A * | 7/1969 | Rogers, Jr. | ..... | A47C 17/22 5/13 |

(Continued)

OTHER PUBLICATIONS

Flexsteel Industries, Inc. Flexsteel Sleeper Innovation Brochure created Sep. 19, 2013 published by Flexsteel Industries, Inc., Dubuque, Iowa, USA.

*Primary Examiner* — Nicholas F Polito
*Assistant Examiner* — Rahib T Zaman
(74) *Attorney, Agent, or Firm* — Ladas & Parry LLP

(57) ABSTRACT

An articulated back sofa bed has a top pivoted back that is aligned at a downwardly forwardly aligned angle in a sitting position and, when a mattress supporting frame is deployed to a bed position an articulation mechanism displaces the seat back rearwardly, to a downwardly rearwardly aligned angle, thereby providing clearance for deployment of the mattress supporting frame clear of the bottom of the back, thereby allowing for a compact overall footprint for the sofa.

12 Claims, 4 Drawing Sheets

(56) References Cited

U.S. PATENT DOCUMENTS 3,657,747 A * 4/1972 Rogers, Jr. ..... A47C 17/1756 5/29
3,857,121 A * 12/1974 Rogers, Jr. ..... A47C 17/1756 5/29
3,925,834 A * 12/1975 Johnson ..... A47C 17/1753 5/13
3,975,783 A 8/1976 Pringle
4,106,137 A 8/1978 Leclerc
4,200,941 A * 5/1980 Gill ..... A47C 17/225 5/13
4,563,037 A * 1/1986 Tiffany ..... A47C 17/2073 297/105
4,651,363 A * 3/1987 Mizelle ..... A47C 17/175 297/411.28
5,103,510 A * 4/1992 Thurow ..... A47C 17/1756 5/37.1
5,187,820 A * 2/1993 Froutzis ..... A47C 17/1756 5/37.1
5,257,424 A * 11/1993 Rogers ..... A47C 27/001 5/13
5,904,401 A * 5/1999 Alberda ..... A47C 17/2076 297/354.13
6,012,190 A 1/2000 Rogers
8,375,482 B1 2/2013 Owens
8,806,672 B1 8/2014 Raymond
2003/0070225 A1* 4/2003 Murphy ..... A47C 17/1753 5/13
2004/0051350 A1 3/2004 Duncan
2006/0096027 A1* 5/2006 Thurow ..... A47C 17/1756 5/37.1
2006/0249993 A1 11/2006 Rogers
2007/0151023 A1* 7/2007 Murphy ..... A47C 17/17 5/13
2008/0258512 A1 10/2008 Rogers
2009/0031494 A1* 2/2009 Pine ..... A47C 17/1756 5/37.1
2011/0203050 A1 8/2011 Rogers
2013/0191989 A1* 8/2013 Smith ..... A47C 17/165 5/17

* cited by examiner

ARTICULATED BACK SOFA BED

CLAIM OF PRIORITY

This application claims priority on Provisional Application 62/085,987 filed Dec. 1, 2014 and having the same inventor and title as the present application.

BACKGROUND OF THE INVENTION

Field of the Invention

The present invention relates generally to a furniture assembly, and more particularly, to a sofa bed or convertible bed having an articulated back permitting deployment and storage of the bed mechanism with minimal extension into a non-furniture area of the environment.

SUMMARY OF THE INVENTION

An articulated back sofa bed has a top pivoted back that is aligned at a downwardly forwardly aligned angle in a sitting position. The back is pivoted to the top of a vertical frame. A mattress supporting frame is stowed underneath the back and becomes the sofa cushion support surface. As the mattress supporting frame is deployed to a bed position an articulation mechanism displaces the seat back rearwardly, to a downwardly rearwardly aligned angle, thereby providing clearance for deployment of the mattress supporting frame clear of the bottom of the back. The crest of curvature of the deployment of the mattress supporting frame is formed and arranged so that the rearward displacement of the back provides sufficient clearance to accomplish the deployment, while the top pivot is fixed to the vertical frame. The rearward displacement of the back is accomplished by a series of links between the mattress support frame and the bottom of the back. This design allows for a compact overall footprint for the sofa.

Description of Related Art

A sofa bed is usually a sofa with a seating surface, a back surface, and arms, which includes a foldable bed located in the area below the seating surface. When being used as a sofa, it appears as any regular sofa designed for seating. When the user wishes to use the sofa bed to convert to a bed, he typically removes the seat and back cushions and pulls out and unfolds the foldable bed mechanism contained within. Examples of this type of arrangement are disclosed in U.S. Pat. Nos. 2,644,171 and 3,975,783.

These sofa beds, while providing a convenient way to provide for overnight guests, have their disadvantages. The mattress is typically thin so that it may be folded when the bed is stored in the sofa. This thin mattress is supported by a metal frame work between which is spread a fabric. Often times the fabric provides insufficient support causing the sleeping surface to sag while the rigid metal frame work causes ridges of hardness. The combination of the sag and the ridges provides an uncomfortable sleeping surface. Further, there is the matter of storing the sofa cushions that are removed. To access and deploy the bed, the seat cushion of the sofa must be removed. The cushions are light in weight, but they are bulky and must be stored somewhere while the bed is in use. Likewise, if the sofa has back cushions, those must be stored as well. Furniture may also have to be moved in order to deploy the bed as is the case if a coffee table is located in front of the sofa. Essentially the entire bed mechanism extends outwardly into a room or vehicle area or the like requiring substantial space in front of the fixed back.

Another type of sofa bed utilizes the rear of the seat back as the sleeping surface. The seat back is usually mounted on a pivot so that the seat back can be rotated to a horizontal position so that the front surface faces down and the rear surface faces up. This type of assembly is disclosed in U.S. Pat. No. 4,106,137. This arrangement provides a better sleeping surface than the former as the bed or mattress does not need to be foldable. This does away with the associated folding metal framework that caused ridges of hardness across the sleeping surface. Another advantage is that the furniture does not need to be moved relative to the floor or room wall to deploy the bed. However, this arrangement is not without its disadvantages as the seat cushions and any back cushions must still be removed to deploy the bed. While this may not be an onerous burden to all, there may not be a convenient place to store the cushions. If the bed is being used in a hotel where housekeeping staff is expected to prepare the bedding, time may be lost in removing or replacing the cushions each time the bedding is changed. Likewise, a hotel guest does not want to be burdened with a cumbersome conversion from one configuration to the other and storage of seating components such as cushions. When used in a vehicle, in particular, storage of extraneous, unused components is difficult.

In addition, many sofa beds and lounge chairs are intended to be situated in certain locations. For example, a sofa bed may be configured for placement against a wall. US Application Pub. No. 20040051350 and U.S. Pat. No. 8,806,672 are examples. In both of these the back frame is fixed, but hollow, to receive part of the mattress. These exemplify the need for the piece of furniture to be located proximate a wall to maximize living space in a room or vehicle, but still require extension of the mechanism into the living space and a fixed back frame.

The present invention solves the problems described above. The sofa bed described herein provides a superior sleeping surface over that of the foldable beds. The sofa bed is easily convertible from the seating configuration to the sleeping configuration without the need for a hollow back or undue need for space for extension into living space due to the articulation of the back to provide clearance for the bed mechanism. Where total space is at a premium, it is wasted by the fixed, spaced, or hollow backs in the prior art.

DETAILED DESCRIPTION

Figure 1:
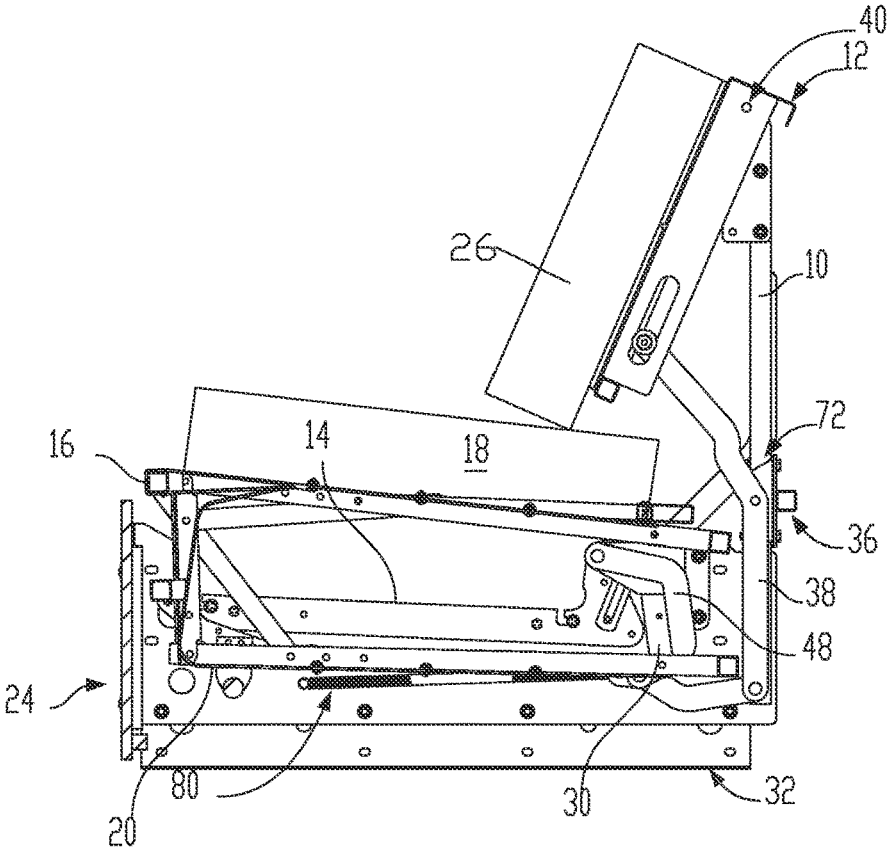
FIG. 1 is a side elevation of the articulated back sofa bed in a seating position.

An articulated back sofa bed 10 has a top pivoted back frame 12 that is aligned at a downwardly forwardly aligned angle in a sitting position. In FIG. 1 the mattress mechanism 14 is stowed. The seat supporting frame portion 16 of the mattress mechanism 14 serves as the support surface for seat cushion 18 when in the stowed position. Seat supporting frame portion 16 is pivotally connected to sleeper side frame 20 with an intermediate portion 17 so that frame portion 16 can be opened and inverted to combine with sleeper side frame 20 to provide a complete mattress supporting surface when the sofa bed is in a bed position. It will be noted that the relative terms front, rear and side may refer, in context, to the orientation of a person using the sofa sleeper in the condition for use, thus when sitting, the arms 22 will be at the "side" but when in the sleep position, because the person will sleep between the arms, both the deployed frames 16 and 20 are oriented toward the person's "sides". Mattress mechanism 14, with frames 16 and 20 folded, is stowed between the arms 22 and front panel 24 and vertical frame 34.

Figure 2:
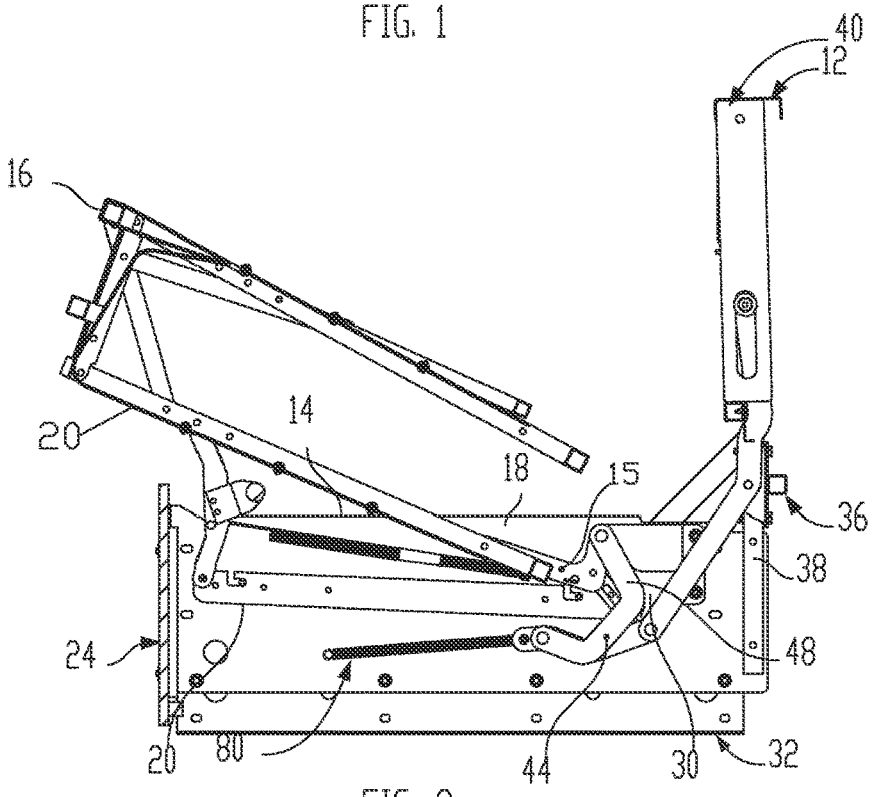
FIG. 2 is a side elevation of the articulated back sofa bed in an intermediate position.

In FIG. 2, as compared to FIG. 1, cushions 18, 26 can be removed and the mattress mechanism 14 deployment to a bed position accomplished. Mechanism 14 travels using linkage 30. In particular sofa bed 10 is formed of fixed side plates or legs 32, a fixed, vertical frame 34 and front panel. Arms 22 may be independent and attached to plates or legs 32, or plates or legs 32 could be configured so as to extend upwardly to form arms. Frame 34 is intended to abut a wall or bulkhead with minimal displacement from spacer 36.

Articulation mechanism 38 displaces the seat back 12 about pivot 40 so that the bottom of back 12 moves rearwardly. More particularly mechanism 38 is formed and arranged with bracket 42 attached to side plates or legs 32. Pivotally attached to bracket 42 is C-shaped link 44 having a top arm 46, center portion 48 and lower arm 50. Link 44 acts through thrust link 52 which is horizontally offset. Thrust link 52 is, in turn, pivotally attached to angled link 54. Link 54 is formed with lower portion 56, center portion 58 and upper portion 60. Link 54 is pivotally mounted to bracket 62, itself mounted to back 12.

Figure 3:
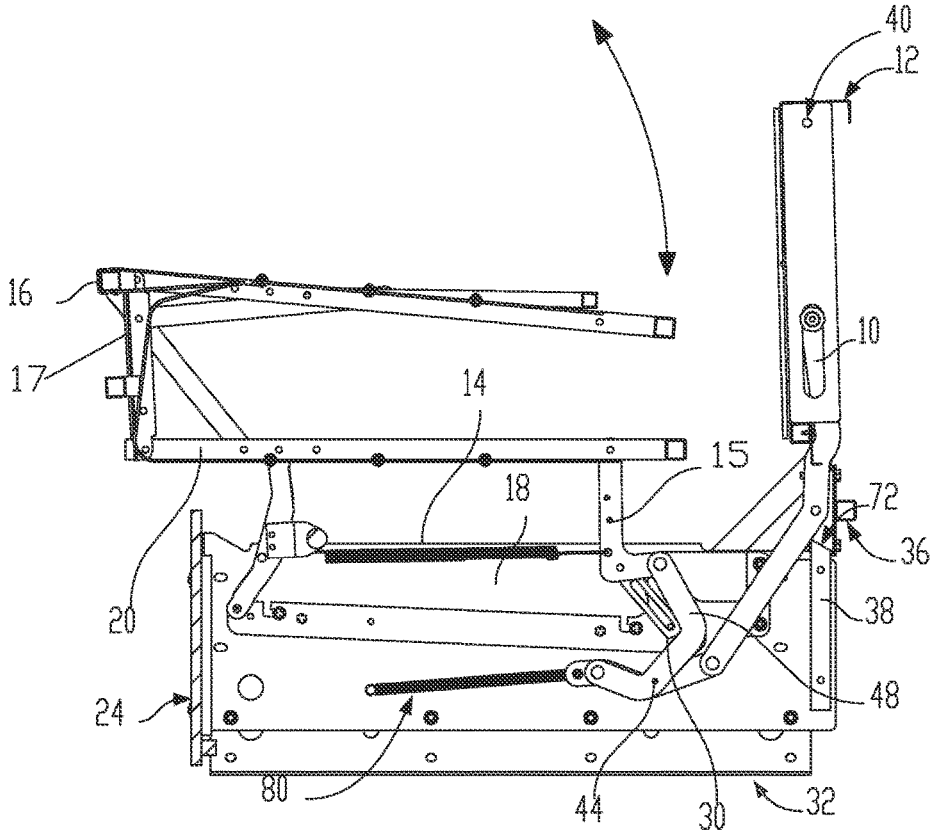
FIG. 3 is a side elevation of the articulated back sofa bed in a mattress frame deployment position.
Figure 4:
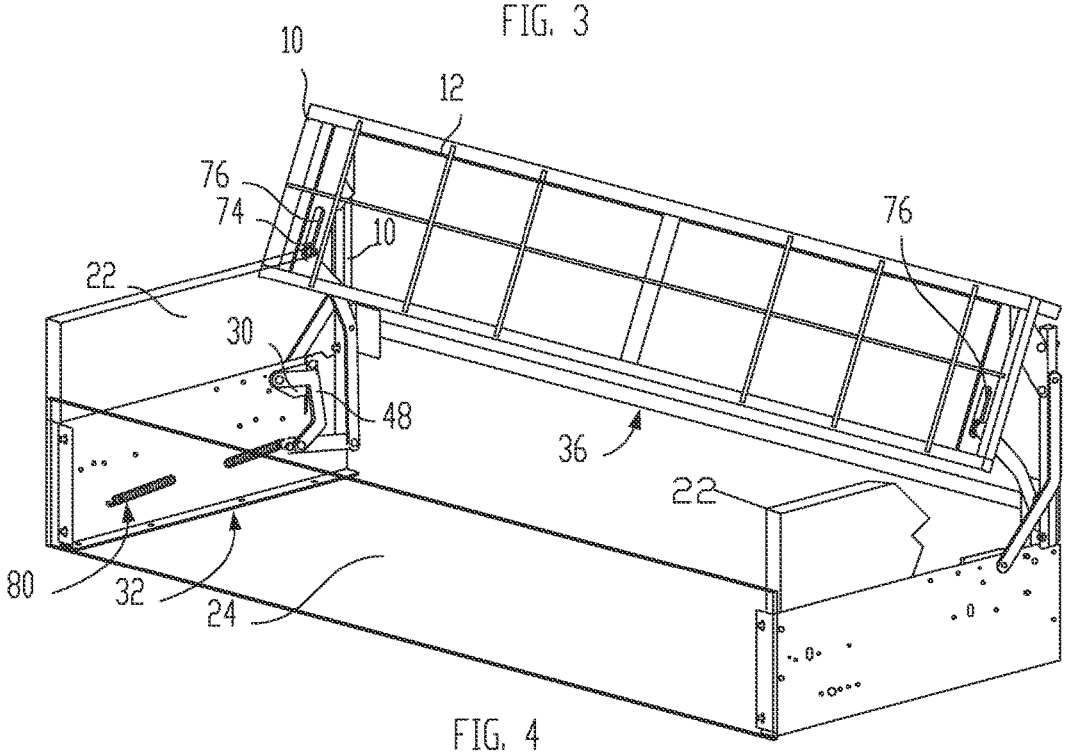
FIG. 4 is a perspective view of the articulated back sofa with the sleep mechanism removed for clarity.
Figure 6:
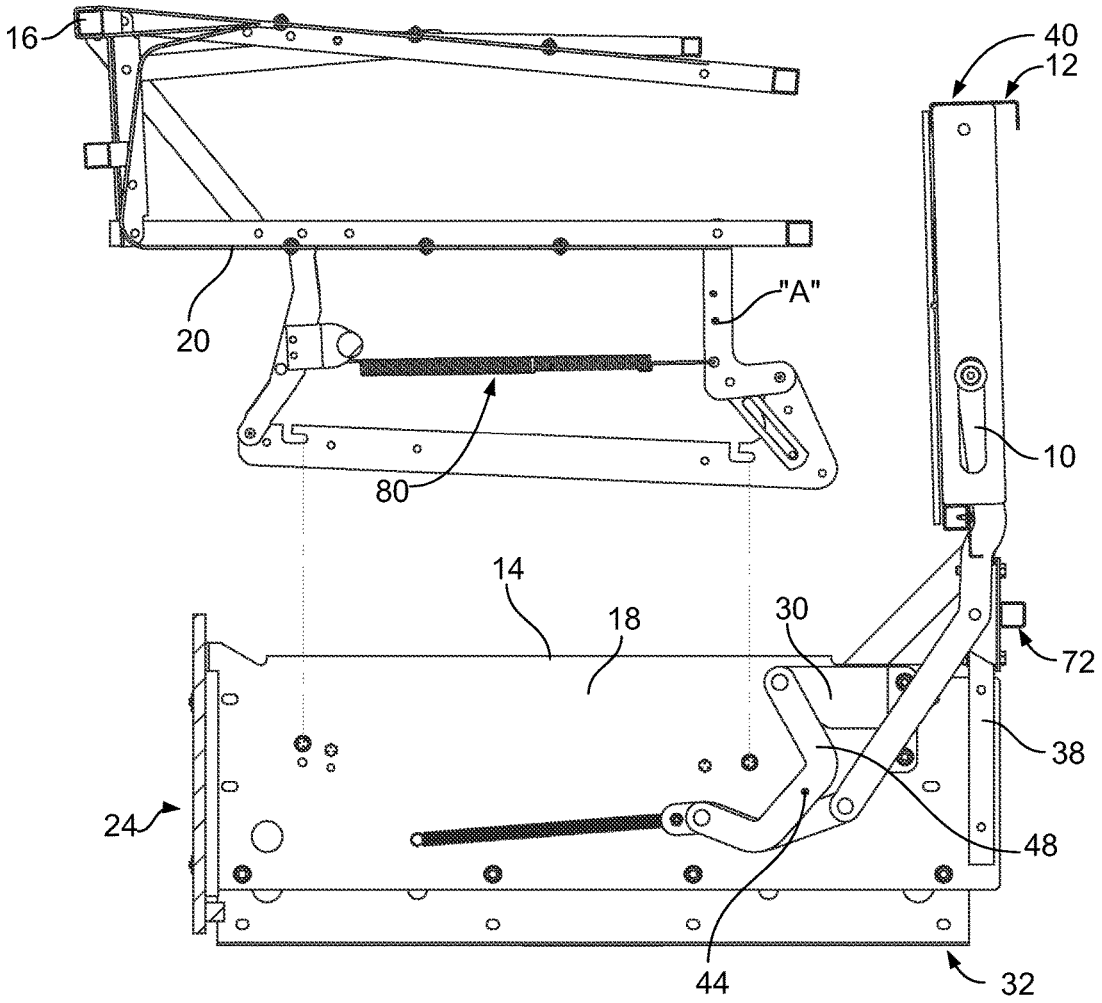
FIG. 6 is a side elevation of the articulated back sofa showing the fitting of the sleep mechanism.

In operation, as shown in FIGS. 2, 3 and 6, as the front of mattress mechanism 14 is lifted, the rear mount 15 of mattress mechanism 14 moves downwardly, and rearwardly actuating C-shaped link 44 proximate the intersection of center 48 and arm 50.

Figure 5:
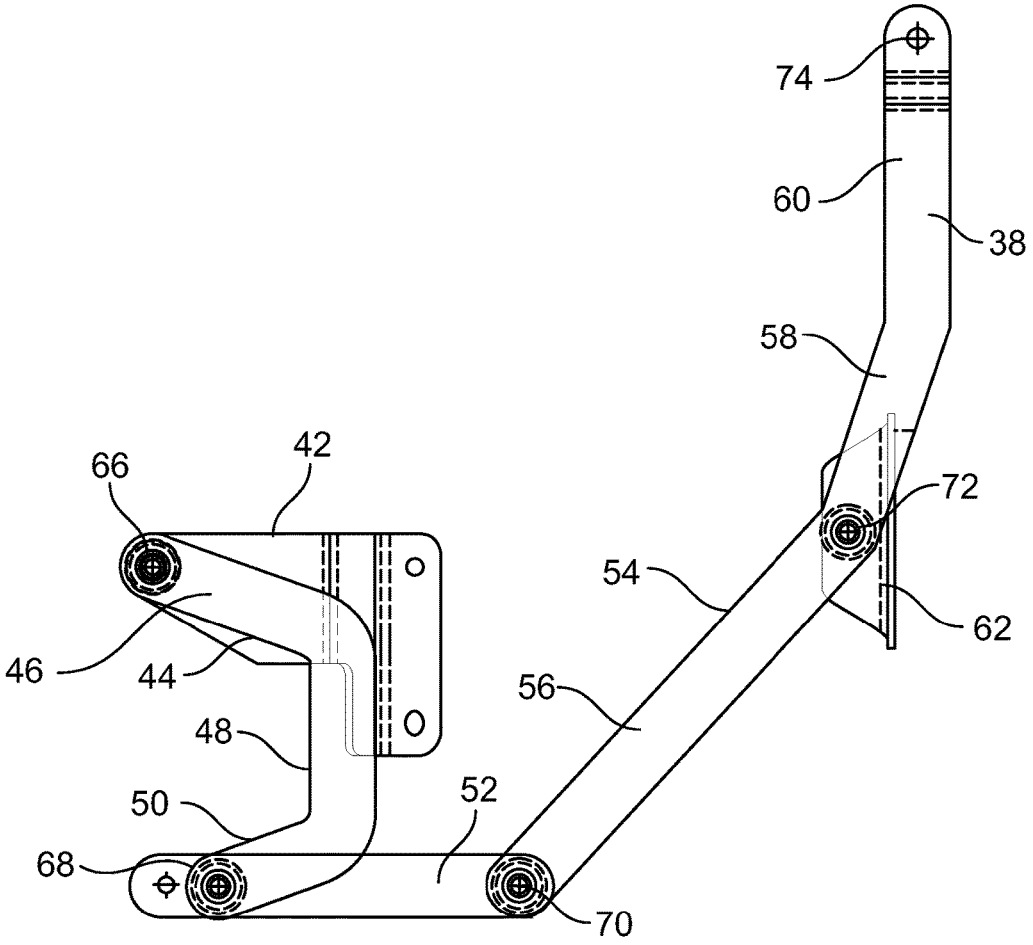
FIG. 5 is a side elevation of the linkage mechanism.

This movement rotates C-shaped link 44 around its fixed pivot 64 at bracket fixed pivot 66 and accordingly, translational pivot 68 is pulled, with link 52 moving generally horizontally, in turn pulling translational pivot 70 and lower portion 56. As lower portion moves, angled link 54 rotates about second fixed pivot 72. Thus, as link 52 moves forwardly, relative to the sofa, leftward in FIG. 5, so moves lower portion 56, while top portion 58 moves rearwardly (rightward in FIG. 5). As this movement takes place, the end 74 of top portion 58 is slidably engaged in a roller slot 76 in back 12 by, preferably, pinned or otherwise fastened roller 78. This motion causes back 12 to rotate on pivot 40 so that the lower portion of back 12 retracts rearwardly, thereby providing clearance for mechanism 14 to be fully deployed to a sleeping position. Resistance against this movement and return force, as mechanism 14 is stowed, is provided by extension spring 80.

In FIG. 3 the back 12 is fully rearwardly positioned, thereby providing clearance for deployment of the mattress mechanism 14 clear of the bottom of the back 12.

I claim:

1. A sofa bed has a top pivoted back frame aligned at a downwardly forwardly aligned angle when the sofa bed is in a sitting position and a mattress mechanism is in a stowed position between arms of the sofa bed, said sofa bed further comprising;

a seat supporting frame portion of the mattress mechanism serves as the support surface for seat cushion when in said stowed position;

said mattress mechanism is formed of a seat supporting frame portion pivotally connected to an intermediate portion and a sleeper side frame such that the mattress mechanism can be stowed and unfolded;

said mattress mechanism moves between said a stowed position and an unfoldable position through operation of a linkage;

said sofa bed has a frame formed of fixed side plates, a fixed, vertical frame and front panel with arms projecting from plates;

said sofa bed has a seat back mounted to a vertical frame and actuated by an articulation mechanism that displaces said seat back about a pivot so that the bottom of said back moves rearwardly;

said articulation mechanism has a first bracket attached to said plates of said sofa bed;

said articulation mechanism has a C-shaped link, said C-shaped link having a top arm, center portion and lower arm, said C-shaped link being is pivotally attached to said bracket;

said C-shaped link is interconnected to a horizontally offset thrust link, which thrust link is pivotally attached to an angled link;

said angled link is formed with a lower portion, center portion and upper portion and said angled link is pivotally mounted to a second bracket;

said second bracket being mounted to the back of the sofa bed whereby movement of a mattress supporting frame actuates said C-shape link to act through said mechanism to retract the back frame to provide clearance to move said mattress supporting frame from a said stowed position, comprising a seating position, to a mattress deployable position;

a back articulation motion urged by said articulation mechanism is effected using an angled link having a top portion with an end, said end of said top portion being in slidable engagement in a roller slot in said back frame so that motion of said top portion causes said back frame to rotate on said pivot so that a lower portion of said back frame retracts rearwardly, thereby providing clearance for mechanism to be fully deployed from said stowed seating position to a mattress deployable position.

2. A sofa bed comprising:

a top pivoted back having a top and a bottom and aligned at a downwardly forwardly aligned angle when said sofa bed is in a sitting position;

said back is pivoted to the top of a vertical frame;

a mattress supporting frame is arranged to be stowed underneath said back and when folded and stowed in the sitting position is adapted to serve as a sofa cushion support surface;

said mattress supporting frame is deployable from to a bed position to a downwardly rearwardly aligned angle adapted to actuate an articulation mechanism which is adapted to displace the back rearwardly when so deployed;

said rearward back displacement is adapted to provide clearance for deployment of the mattress supporting frame clear of the bottom of the back;

a crest of curvature of the deployment of the mattress supporting frame being formed and arranged so that the rearward displacement of the back provides sufficient clearance to accomplish the deployment, while the top pivot is fixed to the vertical frame;

the rearward displacement of the back being accomplished by a series of links between the mattress support frame and the bottom of the back;

said links forming a mechanism having a first bracket attached to side plates of said sofa bed;

said mechanism having a C-shaped link, said C-shaped link having a top arm, center portion and lower arm, said lower arm being pivotally attached to said bracket;

said C-shaped link is interconnected to a horizontally offset thrust link, which thrust link is pivotally attached to an angled link;

said angled link being formed with a lower portion, center portion and upper portion and said angled link is being pivotally mounted to a second bracket;

said second bracket being mounted to the back of the sofa bed whereby movement of a mattress supporting frame actuates said C-shape link to move said mechanism to retract the back to provide clearance to move said mattress supporting frame from a said stowed position, comprising a seating position, to a mattress deployable position.

3. The sofa bed of claim 2 further comprising:

said providing of clearance urged by said articulation mechanism is effected using the end of said upper portion in slidable engagement in a roller slot in said seat back so that motion of said upper portion causes said back to rotate on said pivot so that a bottom of back retracts rearwardly, thereby providing clearance for said mattress supporting frame to be fully deployed from a seating position to a mattress deployable position.

4. The sofa bed of claim 3 further comprising:

said articulation mechanism being urged into a position extending said back outward to a sitting position by a spring, said spring resisting retraction of said back.

5. A sofa bed comprising:

a vertical frame;

a back pivotally attached to said vertical frame;

a leg supporting said vertical frame;

a mattress mechanism including a sleeper portion and a seat supporting portion, said portions being pivotally connected to one another so that when stowed, the seat supporting portion is above the sleeper portion and the mattress mechanism is below said back;

said mattress mechanism is deployable from said stowed condition by lifting a front of said stowed mattress mechanism causing a rear of said stowed mattress mechanism to be displaced rearwardly, so that said rear actuates an articulation mechanism that pivots said back rearwardly thereby providing clearance for said mattress mechanism to be opened;

said leg being a first leg and said vertical frame being a first vertical frame;

a second leg and second vertical frame formed and arranged as a mirror image of said first leg and first vertical frame;

a spacer extending horizontally between said first and second legs;

a front panel attached to said seat supporting portion and positioned substantially parallel to said spacer;

said first and second legs, spacer and panel defining an area in which said mattress mechanism is stowed when in the seating configuration;

a detachable back cushion attached on said back; and a detachable seat cushion attached on said seat supporting portion;

a thrust link;

a reverse C-shaped link pivotally attached to a first end of said thrust link and to a first fixed bracket;

an angled link pivotally attached to a second end of said thrust link, to a bottom of said back, and pivotally to a second fixed bracket.

6. The sofa bed of claim 5, wherein said first fixed bracket is attached to a said seat supporting portion and said second fixed bracket is attached to said vertical frame.

7. The sofa bed of claim 5, wherein said angled link comprises:

a lower portion pivotally attached to said C-shaped link;

a center portion pivotally attached to said second fixed bracket; and an upper portion attached to said back;

wherein said lower portion, said center portion, and said upper portion are connected so that their angular orientation is between a right angles and straight.

8. The sofa bed of claim 5, wherein said C-shaped link is mechanically connected in a manner that enables it to rotates around said first fixed bracket, said thrust link moves forwardly and horizontally, and an upper portion of said angled link moves rearwardly due to a pivot at said second fixed bracket and a center portion of said angled link.

9. The sofa bed of claim 5, wherein said reverse C-shaped link comprises:

a top arm attached to said first fixed bracket;

a center arm; and a lower arm attached to said thrust link.

10. The sofa bed of claim 9, wherein said lower arm is attached to an elongated shaft to control said back.

11. The sofa bed of claim 5, wherein resistance against the movement of said back is provided by one or more extension springs.

12. The sofa bed of claim 8, wherein said upper portion is slidably engaged in a roller slot in said back.

* * * * *